US010627188B2

(12) United States Patent
Cooper

(10) Patent No.: US 10,627,188 B2
(45) Date of Patent: Apr. 21, 2020

(54) THROWING KNIFE

(71) Applicant: William Cooper, Hereford, TX (US)

(72) Inventor: William Cooper, Hereford, TX (US)

( * ) Notice: Subject to any disclaimer, the term of this patent is extended or adjusted under 35 U.S.C. 154(b) by 27 days.

(21) Appl. No.: 15/789,465

(22) Filed: Oct. 20, 2017

(65) Prior Publication Data

US 2018/0209760 A1 Jul. 26, 2018

Related U.S. Application Data

(60) Provisional application No. 62/448,745, filed on Jan. 20, 2017.

(51) Int. Cl.

| | |
|---|---|
| ***B26B 3/00*** | (2006.01) |
| ***F41B 15/00*** | (2006.01) |
| ***B25G 1/00*** | (2006.01) |

(52) U.S. Cl.

CPC ..... *F41B 15/00* (2013.01); *B25G 1/00* (2013.01); *B26B 3/00* (2013.01)

(58) Field of Classification Search

CPC ..... B26B 3/00; F41B 15/00; B25G 1/00

See application file for complete search history.

(56) References Cited

U.S. PATENT DOCUMENTS

| | | | | |
|---|---|---|---|---|
| 940,478 | A * | 11/1909 | Rawalt | B23D 29/005 30/277 |
| 3,772,781 | A | 11/1973 | Newman | |
| 3,834,393 | A * | 9/1974 | Goggins | A61B 17/1604 30/277 |
| 4,470,440 | A * | 9/1984 | Thor | B27L 7/005 144/195.5 |
| 5,642,565 | A | 7/1997 | Riestra | |
| 7,318,783 | B2 | 1/2008 | Polando | |
| 7,331,886 | B2 | 2/2008 | Morris et al. | |
| 2004/0177662 | A1* | 9/2004 | Bosse | A62B 3/005 70/465 |
| 2014/0259682 | A1 | 9/2014 | Makowski | |

* cited by examiner

*Primary Examiner* — Stephen Choi

(57) ABSTRACT

A throwing knife. The throwing knife comprises a body having a first end and a second end. A handle is affixed to the first end of the body, and a blade is affixed to the second end of the body. A weighted member includes a perimeter defining a central channel and is configured to slide between the handle and the body. The weight may include a ring slidably disposed along the body, or a ball inserted into a hollow channel within the body adjacent an optional packing material, or may include both types of weights. The body is narrower than both the handle and the blade, such that a ring weight disposed about the body is configured to slide between a forward edge of the handle when held by a user, and a second position wherein the weight contacts a rear edge of the blade when thrown.

11 Claims, 4 Drawing Sheets

THROWING KNIFE

CROSS REFERENCE TO RELATED APPLICATIONS

This application claims the benefit of U.S. Provisional Application No. 62/448,745 filed on Jan. 20, 2017. The above identified patent application is herein incorporated by reference in its entirety to provide continuity of disclosure.

FIELD OF THE INVENTION

The present invention relates to throwing knives. More specifically, the present invention provides a throwing knife having a sliding weight for imparting a greater impact force when the knife strikes a target.

BACKGROUND OF THE INVENTION

Throwing knives have long been used for self-defense and recreational target practice. Traditional throwing knives are composed of a single piece of material. It can be difficult to throw the throwing knife at a great enough force to cause adequate target penetration. In a recreational setting, throwing knives may be unable to penetrate a practice target and fall from the target upon impact, which lessens the enjoyment of the user and makes it more difficult to track progress. In a self-defense setting, the throwing knife may not penetrate the target adequately. If too little damage is caused, the threat will not be eliminated and the user will still be in danger. In order to address these concerns, the present invention provides a throwing knife having a sliding weight for imparting a greater force upon impact.

Devices have been disclosed in the known art that relate to throwing knives. These include devices that have been patented and published in patent application publications. These devices generally relate to throwing knives having adjustable weighted members. However, these devices have several drawbacks. The weighted members of such knives must be manually adjusted by the user prior to throwing the knife, which can be difficult and time consuming. Further, the prior art devices fail to provide a weighted member specifically designed to impart a greater force upon impact.

In light of the devices disclosed in the known art, it is submitted that the present invention substantially in design elements from the prior art and consequently it is clear that there is a need in the art for an improvement to existing throwing knives. In this regard the present invention substantially fulfills these needs.

SUMMARY OF THE INVENTION

In view of the foregoing disadvantages inherent in the known types of throwing knife now present in the prior art, the present invention provides a throwing knife having a sliding weight for imparting a greater force upon target impact, wherein the same can be utilized for providing convenience for the user when using a throwing knife for recreational or self-defense purposes. The present throwing knife includes a body having a first end and a second end. A handle is affixed to the first end of the body, and a blade is affixed to the second end of the body. A weight is slidably disposed along the body. The weight is configured to slide between a first position wherein the weight contacts a forward edge of the handle and a second position wherein the weight contacts a rear edge of the blade.

One object of the present invention is to provide a throwing knife that is configured to penetrate a target at an adequate depth when thrown, such that the throwing knife supports itself within the target.

Other objects, features, and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
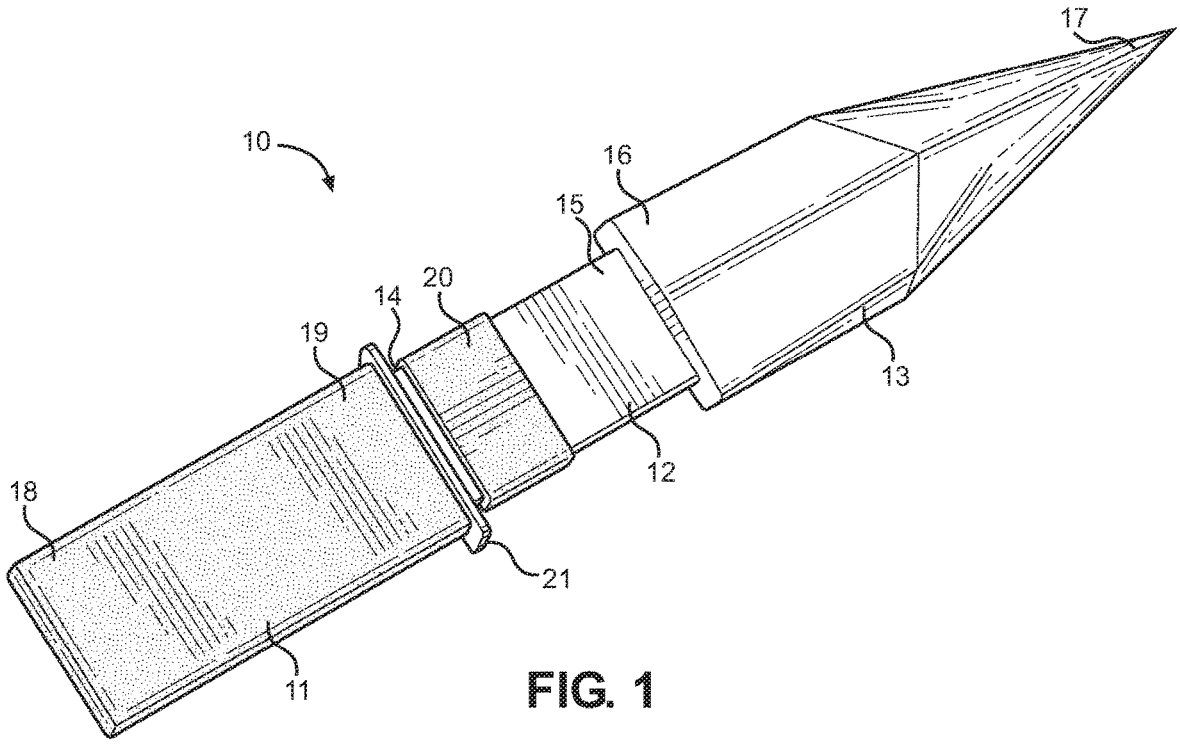
FIG. 1 shows a perspective view of a first embodiment of the throwing knife with the weight in the starting position.

Reference is made herein to the attached drawings. Like reference numerals are used throughout the drawings to depict like or similar elements of the throwing knife. For the purposes of presenting a brief and clear description of the present invention, the preferred embodiment will be discussed as used for recreational or self-defense purposes. The figures are intended for representative purposes only and should not be considered to be limiting in any respect.

Figure 2:
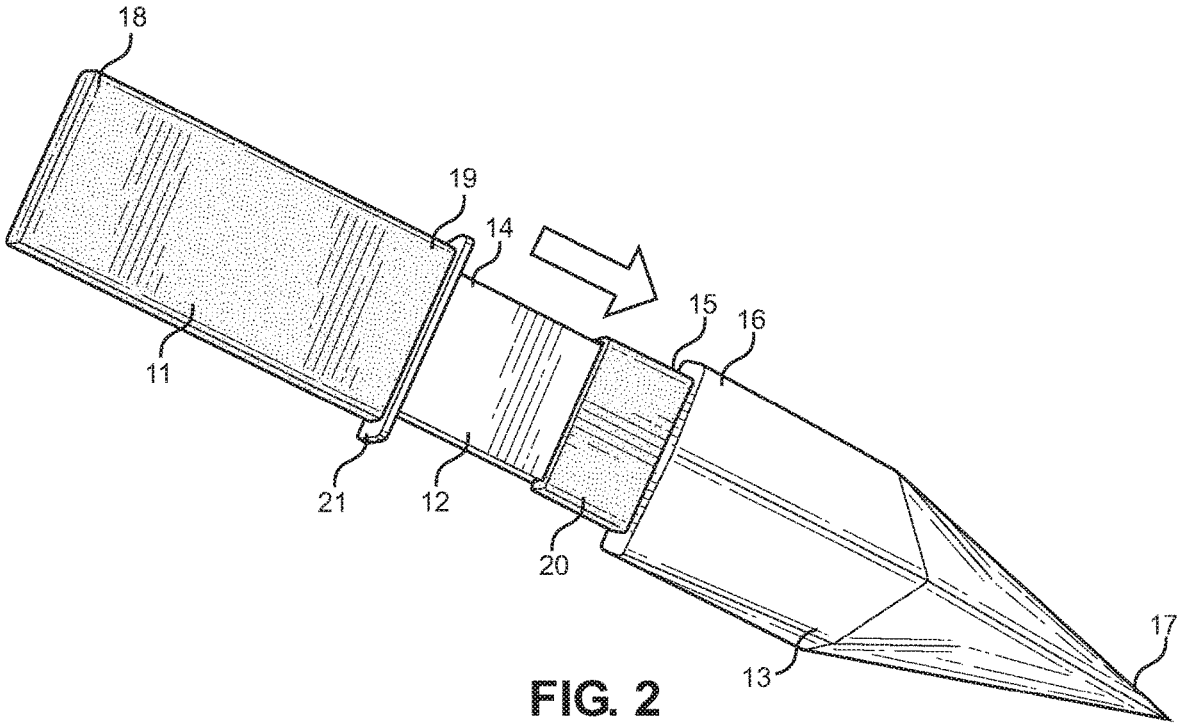
FIG. 2 shows a perspective view of a first embodiment of the throwing knife with the weight in the impact position.

Referring now to FIGS. 1 and 2, there is shown a perspective view of a first embodiment of the throwing knife with the weight in the starting position and a perspective view of a first embodiment of the throwing knife with the weight in the impact position, respectively. The throwing knife 10 comprises a body 12 having a first end 14 and a second end 15. A handle 11 having a rear edge 18 and a forward edge 19 is affixed to the first end 14 of the body 12. The handle 11 may include a contoured surface or a grip thereon for easy handling of the throwing knife 10. In the illustrated embodiment the handle 11 is rectangular, however no claim is made to the exact shape of the handle 11. A blade 13 is affixed to the second end 15 of the body 12.

A weight 20 is slidably disposed along the body 12. The weight 20 comprises a channel through which the body 12 is inserted. In the illustrated embodiment, the weight 20 comprises a rectangular perimeter, and the channel comprises a rectangular cross-section. The width of the body 12 is less than a width of the handle 11 and the blade 13, so that the weight 20 cannot slide past a rear edge 16 of the blade 13 or a forward edge 19 of the handle 11. In some embodiments, the weight 20 is composed of a material having a coefficient of friction less than one, so that the weight 20 may freely and easily slide along the length of the body 12. In other embodiments, the body 12 can be composed of a similar material having a coefficient of friction less than one, further enabling the weight 20 to slide smoothly therealong.

The weight 20 is configured to slide between a first position, or a starting position, and a second position, or an impact position. The sliding of the weight 20 occurs when the throwing knife in 10 is in flight. In the shown embodiment, a flange 21 disposed on the second end 19 of the handle 11 contacts the weight 20 when the weight 20 is in the starting position, prior to the knife 10 being thrown. When the knife 10 is in flight, the weight 20 slides forward along the body 12 and stops when it contacts the first end 16 of the blade 13. The force of the weight 20 causes deeper penetration of the target when a pointed end 17 of the blade 13 contacts the same. As can be clearly seen in the drawings including FIGS. 1-2, a width and a length of the body is less than a width and a length of the handle and the width and length of the body is less than a width and a length of the blade.

Figure 3:
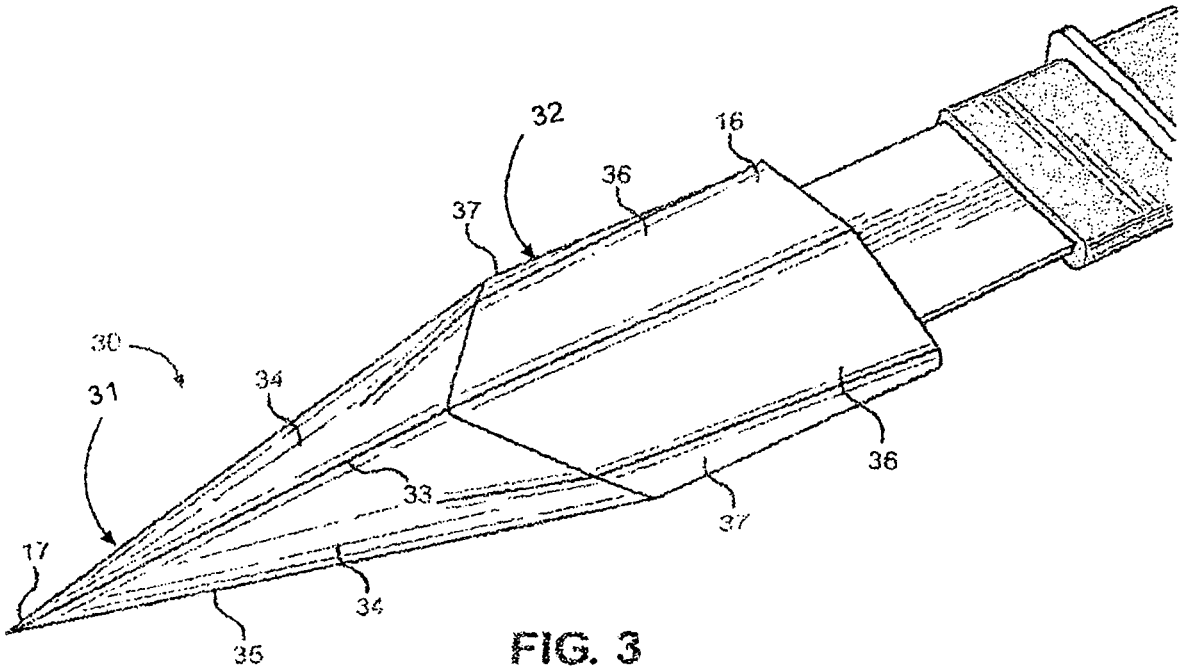
FIG. 3 shows a perspective view of the blade of a first embodiment of the throwing knife.

Referring now to FIG. 3, there is shown a perspective view of the blade of a first embodiment of the throwing knife. The blade 30 comprises a front portion 31 and a rear portion 32, the front portion having a pointed end 17. The pointed end 17 provides for a clean entry of the blade 30 into the target material, because the decreased surface area of the blade 30 allows the target to be penetrated with less force. The blade 30 further includes opposing cutting edges 35 that are configured to cause the blade 30 to penetrate the target cleanly and at an adequate depth, such that the throwing knife supports itself within the target. In the shown embodiment, the front portion 31 is generally triangular while the rear portion 32 is generally rectangular. A rear edge 16 of the rear portion 32 is affixed to the body 12.

A central ridge 33 extends along the length of the blade 30 such that it spans both the front and rear portions 31, 32 thereof. The front portion 31 comprises a pair of front faces 34 that are situated on opposing sides of the ridge 33. The rear portion 32 comprises a first pair of rear faces 36 disposed adjacent to the central ridge 33. A second pair of rear faces 37 extend outward from the first pair of rear faces 36 and terminate at the cutting edges 35. In the shown embodiment, the first pair of rear faces 36 slope downward at an angle less than an angle of the second pair of rear faces 37. The exact geometric configuration of the blade 30 is such that the blade 30 adequately penetrates the target material when the throwing knife is thrown.

Figure 4:
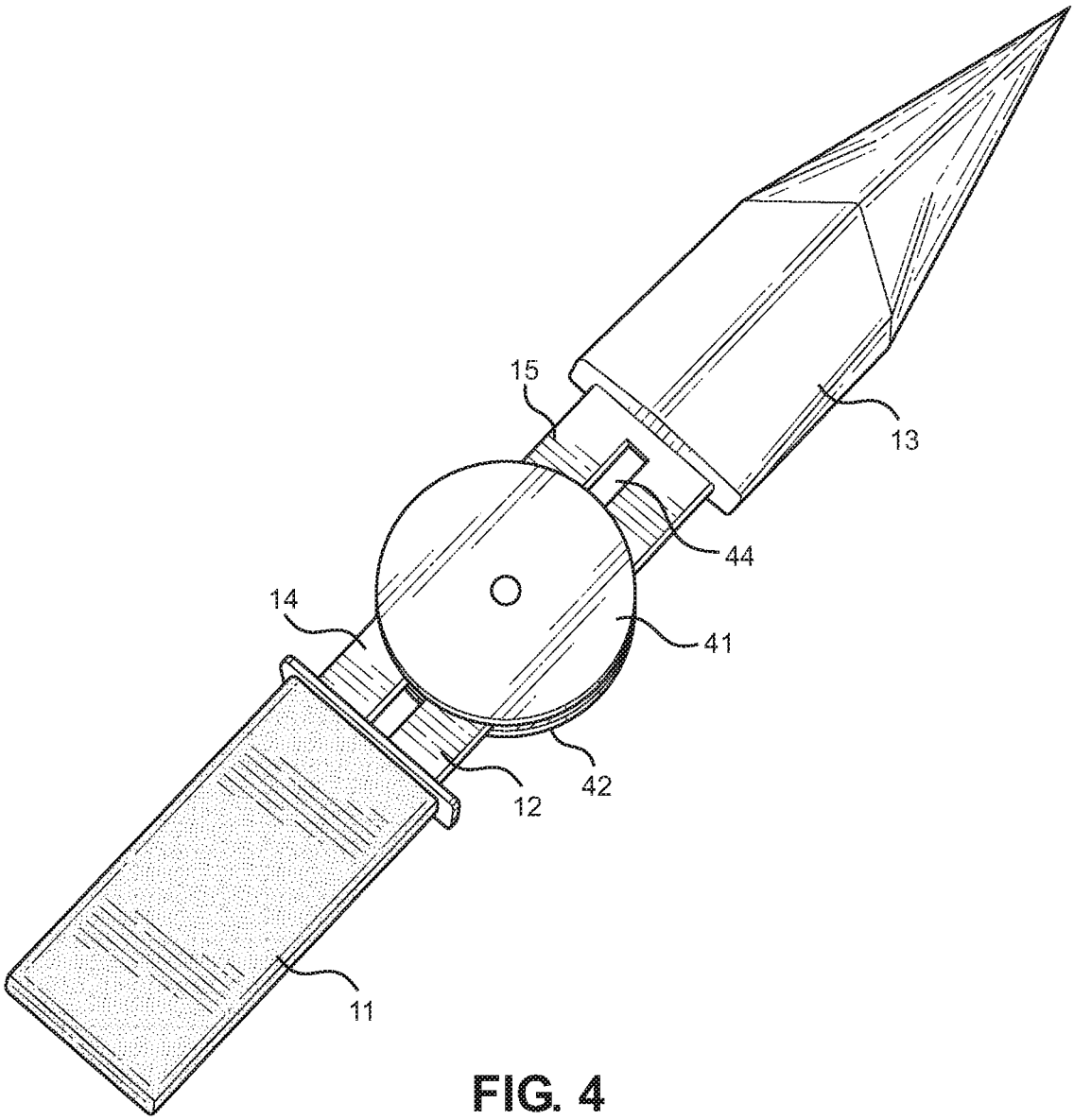
FIG. 4 shows a perspective view of a second embodiment of the throwing knife.

Referring now to FIG. 4, there is shown a perspective view of a second embodiment of the throwing knife. In the shown embodiment, the body 12 includes a central channel 44 that extends from the first end 14 of the body 12 to the second end 15 of the body 12. The weight includes a first member 41 connected to a second member 42 via an axle that extends through the channel 44, such that the first member 41 and second member 42 are positioned on opposing sides of the body 12. The first and second members 41, 42 are shown as circular members that are equal in size in order to maintain a balanced throwing knife that is aerodynamic. The axle is slidably disposed within the channel 44, enabling the first and second members 41, 42 to slide between the handle 11 and the blade 13, similar to the sliding weight in the embodiment illustrated in FIG. 1.

Figure 5:
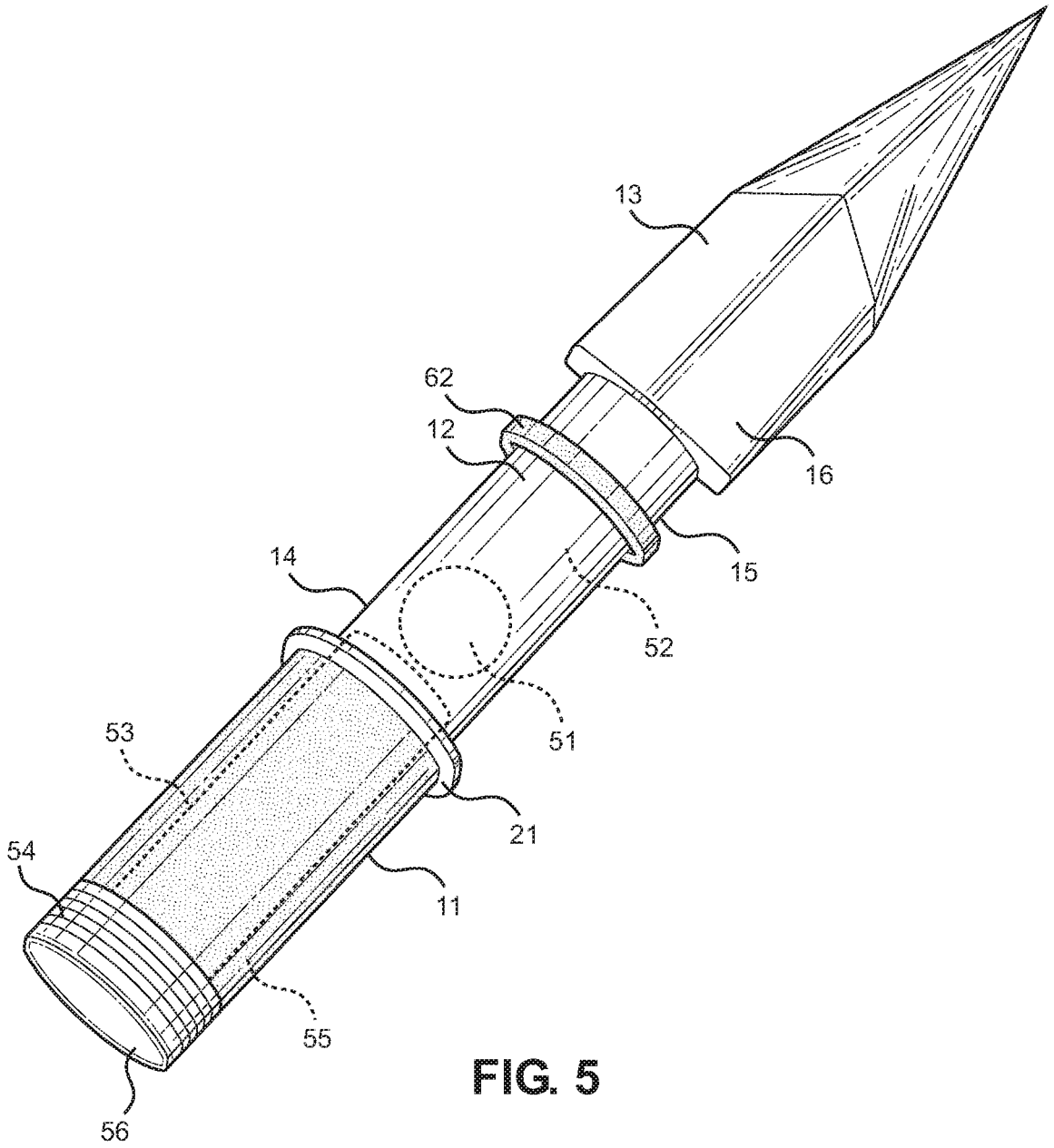
FIG. 5 shows a perspective view of a third embodiment of the throwing knife.

Referring now to FIG. 5, there is shown a perspective view of a third embodiment of the throwing knife. In a third embodiment, the throwing knife includes an interior volume 52 that extends from the second end 15 of the body 12 through the handle 11 and terminates in an open distal end 55. The open distal end 55 can be covered by a removably securable cap 56, which may be removably secured to the handle 11 via a snap fit or frictional connection. Alternatively, the cap 56 can include threads 54 for establishing a threaded connection with the handle 11. The weight 51 is spherical and is removably inserted into the interior volume 52 such that it may roll or slide therein. A spacer 53 is removably inserted into the interior volume 52, such that the weight 51 is positioned between the spacer 53 and the blade 13.

The position of the spacer 53 is maintained via frictional engagement between the outer surface of the spacer 53 and the inner walls of the interior volume 52. To accomplish this, the spacer 53 may be composed of a compressible and resilient material such as foam or packing material. In the shown embodiment, the spacer 53 is sized such that its distal edge terminates at the first end 14 of the body 11. This provides a smaller range of motion for the weight 51. The spacer 52 can be removed if desired, permitting the weight 51 to slide between the blade 13 and the distal end 55 of the handle 11. In this way, the throwing knife may be adjusted to change its flight path and the impact force upon impacting a target. Alternatively, both the weight 51 and the spacer 53 can be removed if a user wishes to use the throwing knife without the sliding weight feature.

In the illustrated embodiment, an additional sliding weight 62 comprising an annular ring 62 is slidably disposed along the body 12. The sliding weight 62 can slide between the flange 21 and the first end 16 of the blade 13. The shown embodiment utilizes the combination of the sliding weight 62 and the ball weight 51 to provide a greater increase in impact force. However, alternate embodiments may only utilize the ball weight 51 if desired. Additionally, some embodiments are configured to be disassembled, i.e., the handle 11 disconnected from the body 12, such that the sliding weight 62 may be removed or added as desired. Overall, the use of multiple weights provides a greater impact force, but the use of a single sliding weight 62 or a single ball weight 51 is encompassed by the present invention.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A throwing knife, comprising:

a body having a first planar surface, a second planar surface, first end and a second end and two opposing edges;

a handle affixed to the first end of the body;

a blade affixed to the second end of the body;

a weight having a third planar surface, a fourth planar surface forming a channel slidably engaged with the body;

wherein a length of the body is less than a length of the handle and a length of the blade and the weight is configured to slide from a position adjacent to the handle to a position adjacent to the blade while the knife is being thrown and suspended in mid-air.

2. The throwing knife of claim 1, wherein a width and length of the body is less than a width and length of the handle and the width and length of the body is less than a width and length of the blade.

3. The throwing knife of claim 1, wherein the handle comprises a flange disposed on the forward edge thereof.

4. The throwing knife of claim 1, wherein the body and weight is composed of a material, the material having a coefficient of friction less than one.

5. The throwing knife of claim 1, wherein a width of the channel is greater than a width of the body.

6. The throwing knife of claim 5, wherein the perimeter of the weight is rectangular, and wherein the channel comprises a rectangular cross-section.

7. The throwing knife of claim 1, wherein the blade comprises a central ridge terminating in a pointed end and a pair of cutting edges disposed on opposing sides of the central ridge.

8. The throwing knife of claim 7, wherein the blade further comprises a front portion and a rear portion, wherein the front portion comprises a pair of opposing front faces extending from the central ridge, wherein each front face terminates at one of the cutting edges.

9. The throwing knife of claim 8, wherein the front portion is triangular and the rear portion is rectangular.

10. The throwing knife of claim 8, wherein the rear portion of the blade comprises a first pair of sloped rear faces that terminate at a first edge of a second pair of sloped rear faces, wherein the second pair of sloped rear faces terminate at one of the cutting edges.

11. The throwing knife of claim 10, wherein the first pair of sloped rear faces slope downward at an angle less than an angle of the second pair of sloped rear faces.

* * * * *